US005135405A

United States Patent [19]

Fusselman et al.

[11] Patent Number: 5,135,405

[45] Date of Patent: Aug. 4, 1992

[54] CONNECTORS WITH GROUND STRUCTURE

[75] Inventors: David F. Fusselman, Middletown; Peter K. Townsend, Camp Hill, both of Pa.

[73] Assignee: E. I. Du Pont de Nemours and Company, Wilmington, Del.

[21] Appl. No.: 766,994

[22] Filed: Sep. 27, 1991

Related U.S. Application Data

[62] Division of Ser. No. 536,855, Jun. 8, 1990, abandoned.

[51] Int. Cl.[5] ..... H01R 4/66

[52] U.S. Cl. ..... 439/108; 439/608

[58] Field of Search ..... 439/81, 80, 607-610, 439/79, 108, 95

[56] References Cited

U.S. PATENT DOCUMENTS

| | | | |
|---|---|---|---|
| 4,874,319 | 10/1989 | Hasirloglur | 439/608 |
| 4,914,062 | 4/1990 | Voltz | 439/608 |
| 4,959,626 | 9/1990 | Monime | 439/607 |
| 4,975,084 | 12/1990 | Fedder et al. | 439/608 |

*Primary Examiner*—Larry I. Schwartz
*Assistant Examiner*—Hien D. Vu
*Attorney, Agent, or Firm*—John E. Griffiths

[57] ABSTRACT

The present invention relates to electrical connectors with a ground structure for impedance and cross talk control between signal carrying conductors.

9 Claims, 5 Drawing Sheets

CONNECTORS WITH GROUND STRUCTURE

CROSS REFERENCE TO RELATED APPLICATION

This is a divisional application of copending U.S. patent application Ser. No. 07/536,855 filed Jun. 8, 1990 now ABN.

BACKGROUND OF THE INVENTION

1. Field of the Invention

This invention relates to electrical connectors with a ground structure for impedance and cross talk control between signal carrying conductors.

2. Description of Related Art

With the advance of technology, a high density of electronic circuits and components can be located on a printed wiring board or printed circuit board (PCB). Along with this miniaturization of electronic circuits and components, electrical connectors are needed to electrically and mechanically interconnect one PCB, such as a back panel or mother board, to one or more other PCBs, such as daughter boards. Further, it is typically desirable for such connectors to have a high signal density capacity. That is, the connectors should permit a high number of signals to pass through the connector per unit volume of the connector. However, electrical signals carried on a conductor can interfere with a signal carried on an adjacent conductor.

This interfering electrical effect that an electrical signal carried on a given conductor exerts on a signal carried on an adjacent conductor is referred to as "cross talk." Controlling this cross talk is especially important in high density connectors. Such control can be implemented in a variety of ways.

One method of controlling cross talk is to connect certain terminals in a high density connector to conductive areas of a printed circuit board that are in turn grounded or connected to a predetermined ground potential. This solution is external to the connector.

U.S. Pat. Nos. 4,655,518 (to Lennart B. Johnson et al.), 4,686,607 (to Lennart B. Johnson) and 4,869,677 (to Lennart B. Johnson et al.) disclose a daughter board-/backplane assembly with contact elements dedicated for grounding purposes. Header contact elements have contacts that can be connected to ground or a predetermined potential on a backplane. The header contact elements have other spring contacts carried by an inside header wall for touching contacts carried by a right angle receptacle outer wall. Other contacts are integral with and perpendicular to the contacts carried by the right angle receptacle outer wall for connection to the daughter board.

U.S. Pat. No. 4,601,527 issued to Timothy A. Lemke discloses an internal shielding structure for connectors, specifically in vertical and right angle headers. The shielding structure includes a ground strip affixed to a mating surface of a header housing. The shielding structure further includes an elongated conductive spring contact with contact beams that extend in holes of side walls of the housing, lock tabs that connect to the ground strip and ground bars for connection to a grounded chassis.

U.S. Pat. No. 4,824,383 issued to Timothy A. Lemke discloses a shielding structure in connectors or plug-type terminators for either a multiple conductor cable or a multiple tracing substrate that electrically isolates individual or groups of contact elements in the terminator to prevent or minimize cross talk between adjacent conductors and to prevent or minimize degradation of signal transmission. The terminator includes a ground structure with generally U-shaped channels. Contact elements extend into the channels. The ground structure is connected to a predetermined potential, rather than dedicating some of the contact elements for this purpose.

U.S. Pat. No. 4,898,546 issued to Richard A. Elco et al. discloses a ground shield device for right angle connectors. A different one of the shield devices straddles alternate columns of contact elements in the connector. Each shield device clips to a tail of one of the contact elements straddled by the shield device. The shield devices are connected to ground or a predetermined potential.

It is an object of this invention to provide high density electrical connectors for electrically and mechanically interconnecting electronic circuits and/or components controlling impedance and/or cross talk within the connectors.

Furthermore, it is an object of this invention to provide high density electrical connectors for electrically and mechanically interconnecting a circuit assembly and a plurality of terminals arranged in rows and columns in a mating connector to control impedance and-/or cross talk thereby to reduce, prevent or minimize degradation of signal transmission within the receptacles.

SUMMARY OF THE INVENTION

The present invention is directed to an electrical connector for electrically and mechanically interconnecting a circuit assembly having a plurality of contact regions and a mating connector having first side walls, a plurality of first contacts arranged in rows and columns within the first side walls and at least one second side contact, the connector comprising:

an insulative housing having second side walls and a plurality of passages arranged in rows and columns within the second side walls;

a first plurality of electrical contact elements wherein:

one of the contact elements is partially in each one of the passages, each contact element has a third contact and a fourth contact, the third contacts are arranged in rows and columns for contacting the first contacts, each one of the contact elements includes a middle portion configured such that their fourth contacts extend at an angle or perpendicularly with respect to the third contacts, at least one conductor having at least one fifth contact and at least one sixth contact, the at least one fifth contact on one of the second side walls for contacting the at least one second contact on one of the first side walls; and a conductive shield including:

a baffle positioned between and spaced from columns of the middle portions of the contact elements, a seventh contact for contacting each of the sixth contacts, and a plurality of eighth contacts positioned such that the fourth contacts and the eighth contacts are arranged in rows and columns for connection to the circuit assembly contact regions.

BRIEF DESCRIPTION OF THE DRAWINGS

The invention can be more fully understood from the following detailed description thereof in connection with accompanying drawings which form a part of this application and in which.

DESCRIPTION OF THE PREFERRED EMBODIMENT(S)

Figure 1:
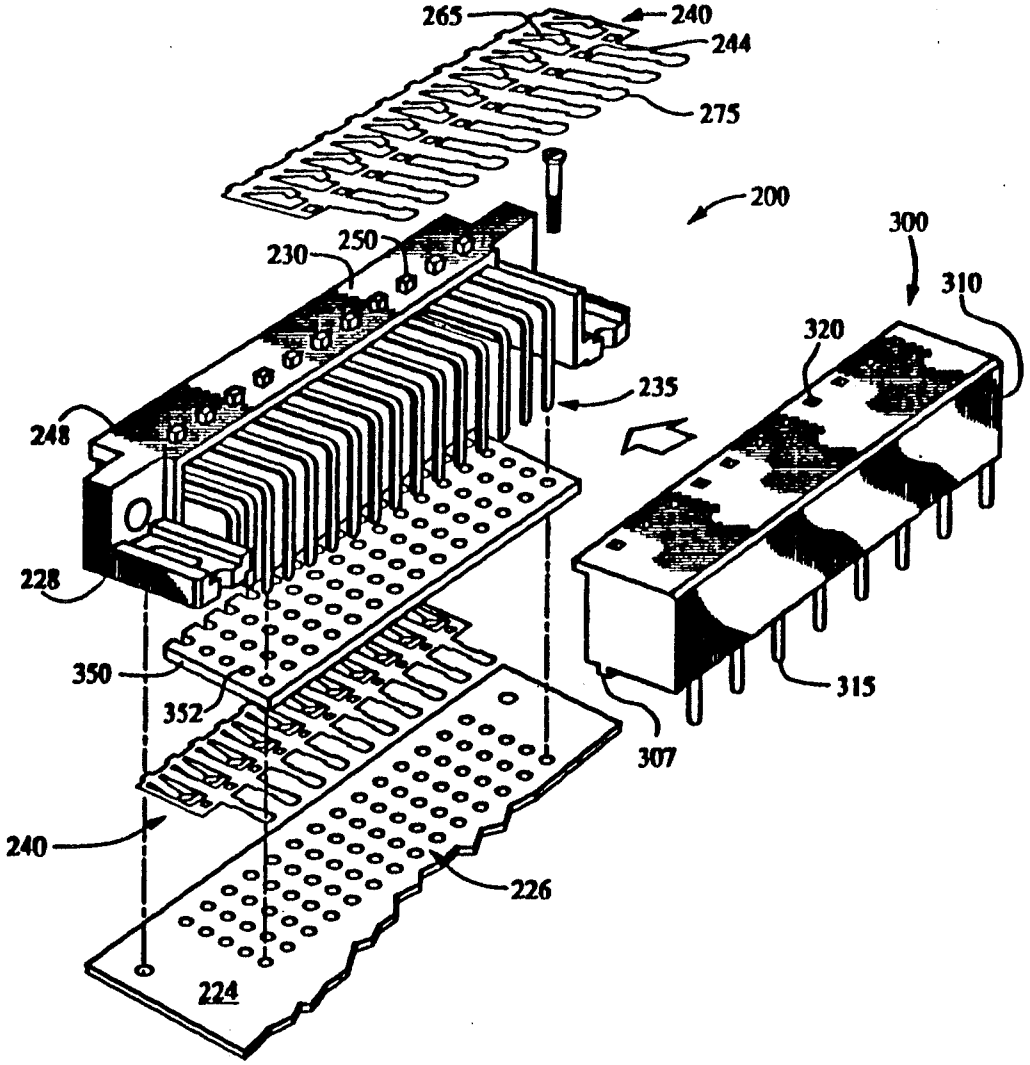
FIG. 1 is an exploded perspective view of a high density connector assembly in accordance with the present invention, the assembly including a high density angled or right angle connector for interconnecting a circuit assembly and a mating connector.

Throughout the following detailed description, similar reference characters refer to similar elements in all figures of the drawings.

Referring to FIG. 1, there is illustrated an exploded perspective view of a high density connector assembly in accordance with the present invention. The assembly includes a high density angled or right angle connector or receptacle 200 for interconnecting a first circuit assembly 224 and a mating connector (not depicted). The angled or right angle electrical receptacle 200 is for electrically and mechanically interconnecting a circuit assembly 224 having a plurality of contact regions 226 and a mating or second connector having first side walls, a plurality of first contacts arranged in rows and columns within the first side walls and at least one second side contact. Suitable connectors that can be used for mating with the connector 200 of the present invention are disclosed in U.S. patent application Ser. No. 07/536,855 filed Jun. 8, 1990 now ABN, which is hereby incorporated by reference.

Figure 2:
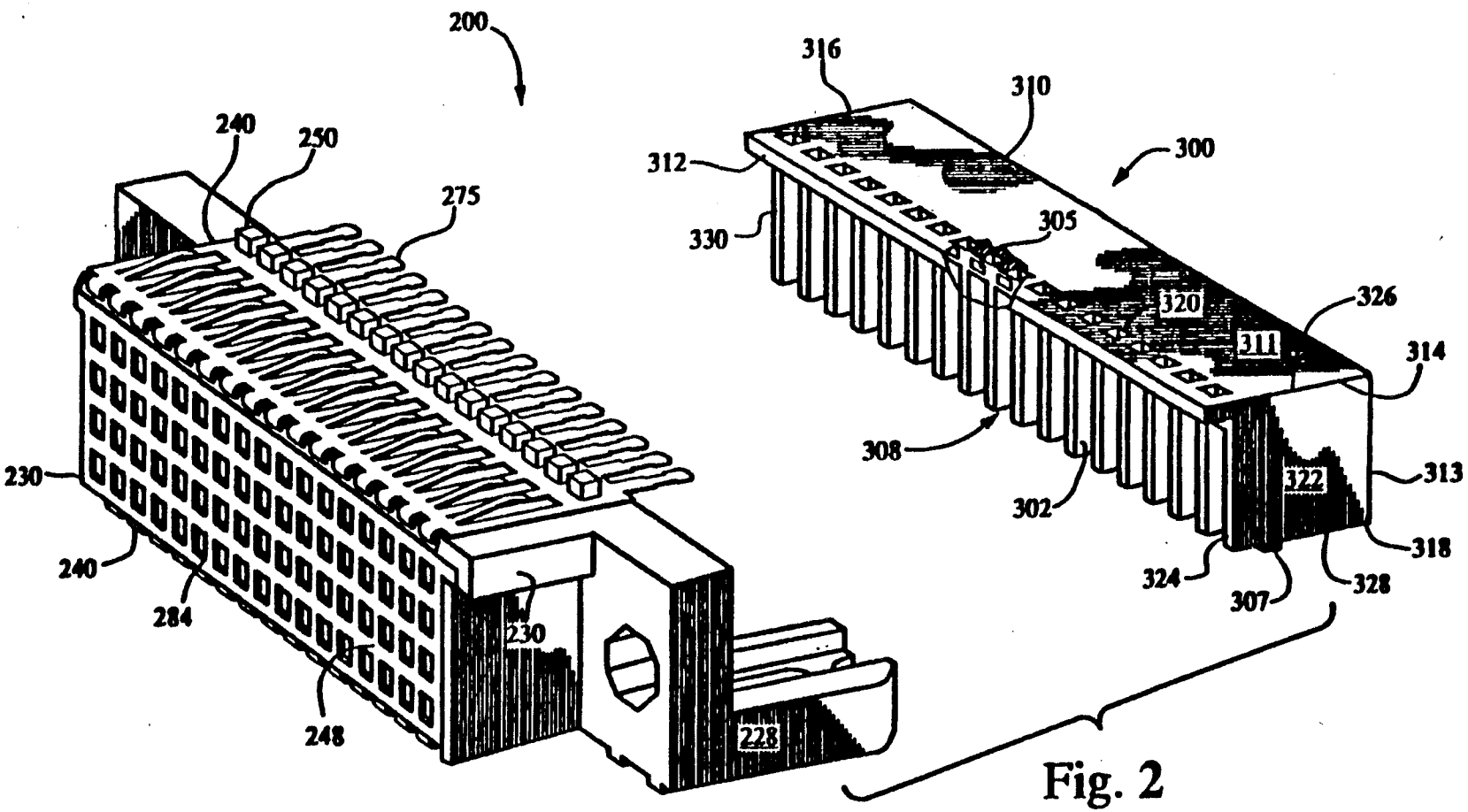
FIG. 2 is a partially exploded perspective view of the high density connector of FIG. 1, the connector including a shield exploded from a housing, the view directed generally towards a top or first mating side of the connector.
Figure 5:
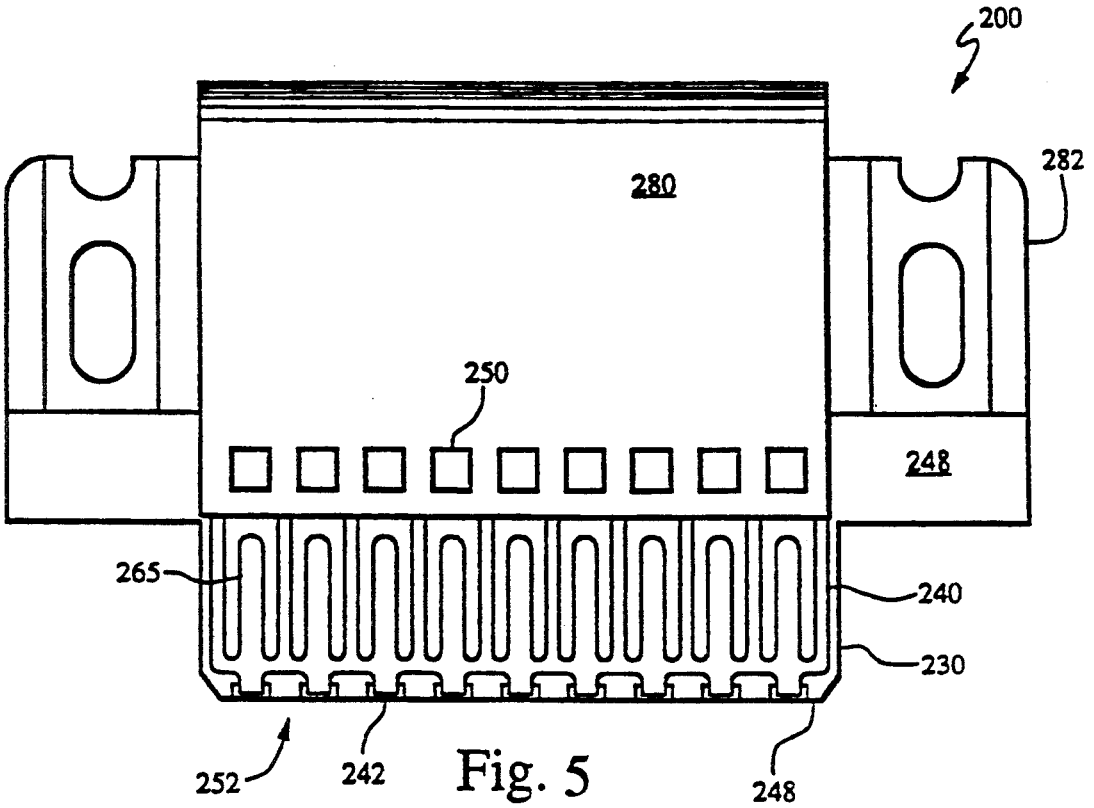
FIG. 5 is an enlarged view of a back side of the angled or right angle connector of FIG. 1.
Figure 3:
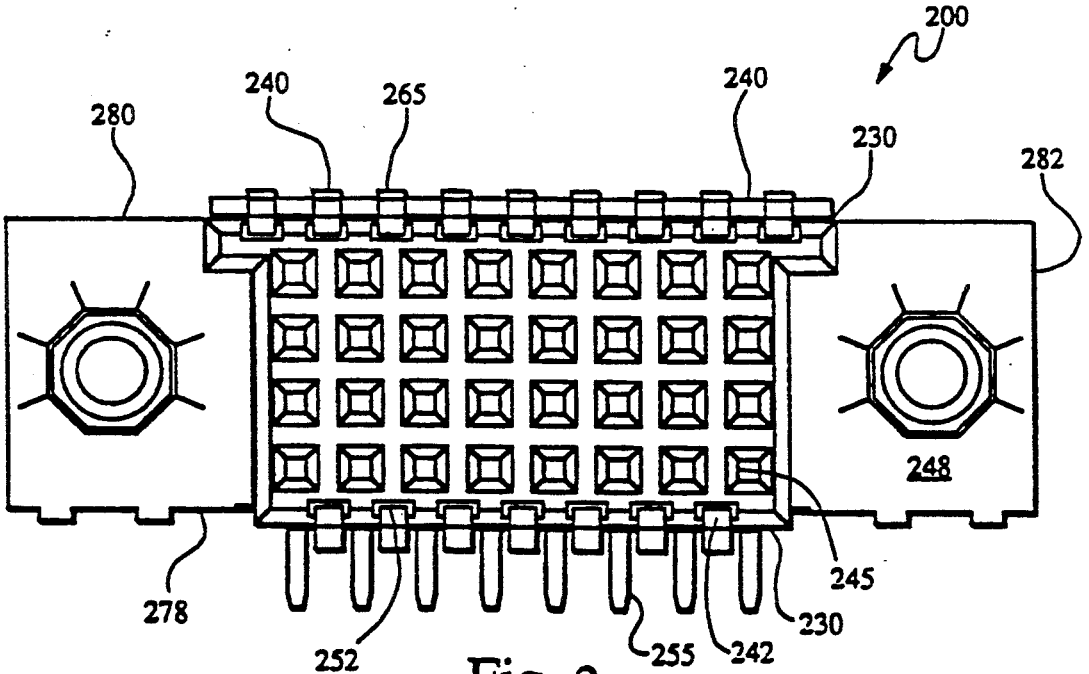
FIG. 3 is an enlarged view of a top or first mating side of the high density angled or right angle connector of FIG. 1.
Figure 6:
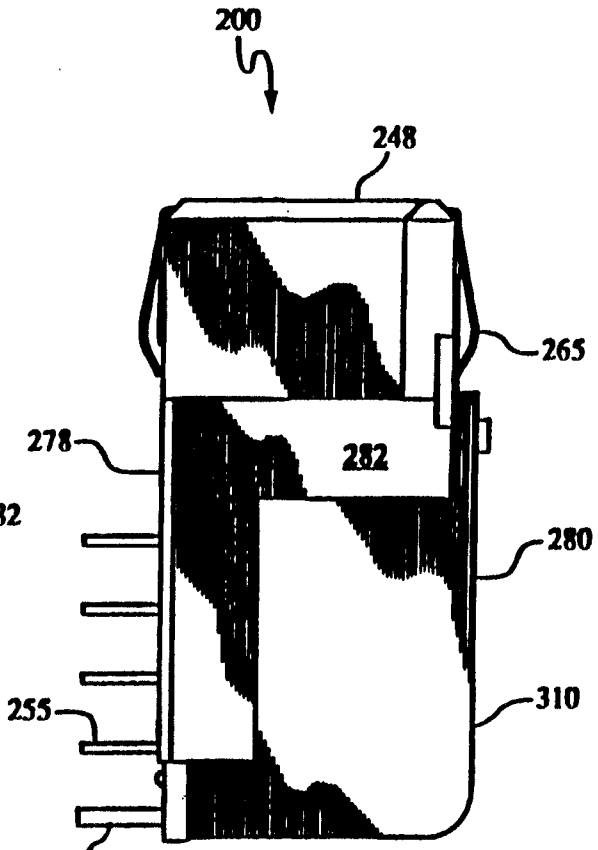
FIG. 6 is an enlarged view of an end of the angled or right angle connector of FIG. 1.
Figure 4:
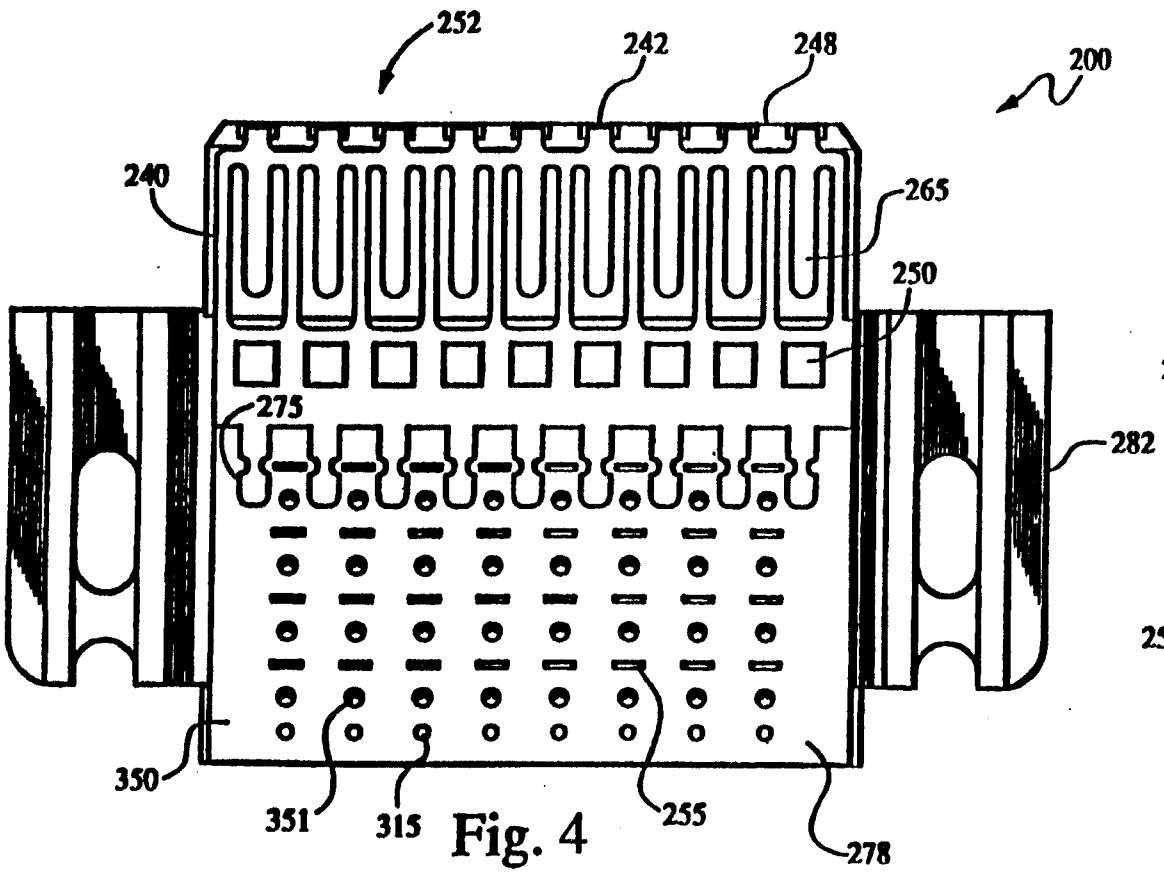
FIG. 4 is an enlarged view of a front or second mating side of the angled or right angle connector of FIG. 1.
Figure 7:
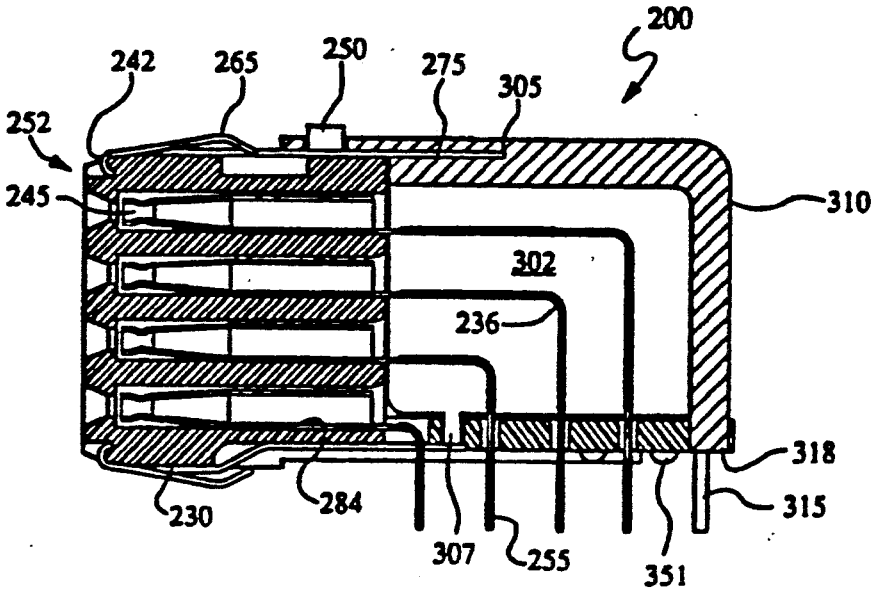
FIG. 7 is a sectional view of the angled or right angle connector of FIGS. 1–6.

FIG. 2 is an exploded view of the high density angled or right angle receptacle 200 of FIG. 1. FIG. 3 is an enlarged view of a top or first mating side 248 of the high density angled or right angle receptacle 200 of FIG. 1. FIG. 4 is an enlarged view of a front or second mating side 278 of the angled or right angle receptacle 200 of FIG. 1. FIG. 5 is an enlarged view of a back side 280 of the angled or right angle receptacle 200 of FIG. 1. FIG. 6 is an enlarged view of an end 282 of the angled or right angle receptacle 200 of FIG. 1. FIG. 7 is an enlarged cross section of the high density angled or right angle receptacle 200.

The angled or right angle receptacle 200 comprises an insulative housing 228, a plurality of first conductive electrical contact elements 235 mounted in the housing 228, at least one conductor 240 and a conductive shield 300.

The insulative housing 228 has a first, header or shroud, mating surface 248, second side walls 230 and a plurality of passages 284 within the second side walls 230. The passages 284 are arranged in rows and columns extending perpendicularly from the first mating surface 248 through the housing 228. The housing 228 may have any means for aligning the housing 228 with the conductors 240 and the shield 300. The housing alignment means may comprise projections (or alternatively slots) 250.

The conductive electrical contact elements 235 may have any configuration so long as they are useable as angled or right angle contact elements. In other words, they may be male elements, female elements or gender neutral. More specifically, each one of the conductive electrical contact elements 235 has a third contact 245 and a fourth contact 255. The third contacts 245 can be socket shaped or spring beams. The fourth contacts 255 can be substantially flat solder tails. One of the third contacts 245 is secured in each one of the passages 284 for contacting one of the contacts of a mating connector. The third contacts 245 are generally parallel to one another and arranged in rows and columns. There can be any number of rows and any number of columns of the third contacts 245. However, there are preferably at least two rows and at least two columns. Typically, there are three, four, five or six rows of the third contacts 245. The Figures depict four rows of the third contacts 245. Typically, there are many columns of the third contacts 245. Each one of the contact elements 235 has a middle portion 236 configured such that their fourth contacts 255 extend at an angle or perpendicularly with respect to the third contacts 245. The middle portions 236 may have a right angle bend, two 45 degree angle bends, etc. The fourth contacts 255 can be through mount contacts or surface mount contacts.

Each one of the conductors 240 has at least one fifth contact 265 and at least one sixth contact 275. Preferably, each one of the conductors 240 has a plurality of the fifth contacts 265 and a plurality of the sixth contacts 275. The fifth contacts 265 on each of the conductors 240 are on one of the second side walls 230 for contacting contacts on side walls of a mating connector. Preferably, the fifth contacts 265 on each of the conductors 240 is on an exterior surface of one of the second side walls 230. Preferably, there are two of the conductors 240 and the conductors 240 are on different ones of the second side walls 230 that are generally parallel to the rows of the contact elements 235. Each one of the conductors 240 can be an elongated shield member as illustrated in the Figures with at least one bent end portion 242 for extending into corresponding retaining grooves or slots 252 in the mating surface 248 of the connector 200. When the bent end portions 242 are extending into the retaining grooves or slots 252 and the sixth contacts 275 are connected to seventh contacts 305 and/or 307 on the shield 300, then the conductors 240 are properly aligned or positioned on the second side walls 230. Alternatively, each one of the conductors 240 can comprise a plurality of individual conductor elements with each one of the conductor elements having one of the fifth contacts 265 and one of the sixth contacts 275. The conductors 240 can be "on" the side walls 230 by any means. For instance, the fifth contacts 265 of the conductors 240 can be a conductive coating on the side walls 230. The conductors 240 may have any means for securing the conductors 240 on the housing 228 and the shield 300 and/or any means for aligning the conductors 240 with the housing 228 and the shield 300. The conductor securing means and the alignment means may comprise slots (or alternatively projections) 244.

FIG. 2 is a perspective view of the high density angled or right angle receptacle 200 of FIG. 1. The view of the receptacle 200 in FIG. 2 shows the shield 300 exploded from the housing 228. The view is directed generally towards the top or first mating side 248 of the receptacle 200. The shield 300 includes a baffle 302 positioned between and spaced from columns of the middle portions 236 of the contact elements 235. Preferably, one of the baffles 302 is between each pair of adjacent columns of the middle portions 236 of the contact elements 235. The shield 300 and the baffles 302 can be made of any conductive material. Alternatively, the shield 300 and/or the baffles 302 can be polymeric and have a conductive layer or coating. The shield 300 includes a seventh contact 305 or 307 for contacting each of the sixth contacts 275 on the conductors 240. Preferably, the seventh contacts 305 are slots or holes in the shield 300 for receiving the sixth contacts 275 of one of the conductors 240. Preferably, the seventh contacts 307 are extensions from the baffles 302.

The shield 300 further includes a plurality of eighth contacts 315 positioned such that the eighth contacts 315 and the fourth contacts 255 are arranged in rows and columns for connection to the contact regions 226 of the circuit assembly 224. It is within the scope of this invention for the eighth contacts 315 to be arranged in one or more rows and in such row(s) with or without fourth contacts 255 positioned in the row(s) with the eighth contacts 315. Preferably, the fourth contacts 255 are solder tails. Preferably, the eighth contacts 315 are pin shaped. The eighth contacts 315 can be cast out of the same metal as the rest of the shield 300. Alternatively, the eighth contacts 315 can be conductive pins secured in holes in or through a wall 310 of the shield 300.

Preferably, the shield 300 further comprises an elongated outer side wall 310 connected to each of the baffles 302. The elongated outer side wall 310 and adjacent pairs of the baffles 302 define pockets 308 for the middle portions 236 of one column of the contact elements 235. To ensure that the middle portions 236 do not short out by contacting a conductive portion of the shield 300, the pockets 308 can be coated with an insulative layer. The elongated outer side wall 310 may extend generally between the housing 228 and the fourth contacts 255. The elongated outer side wall 310 may be one continuous wall with a bend generally following the bend of the middle portions 236. If the bend of the wall 310 is substantially a right angle, then the wall 310, in effect, becomes a first elongated outer wall 311 connected to a second elongated outer side wall 313. The side wall 310 may have a first edge 312, a second edge 314, a third edge 316 and a fourth edge 318. The first edge 312 is positioned adjacent one of the conductors 240.

The shield 300 may have any means for aligning the shield with the conductors 240 and the housing 228. For instance, the first edge 312 or a portion near the first edge 312 may have slots, projections or teeth 320 for mating with projections or slots 250 in the housing 228.

The shield 300 may have a first end wall 322 having a first edge 324, a second edge 326 and a third edge 328. The first edge 324 of the first end wall 322 is for contacting the housing 228. The second edge 326 of the first end wall 322 may be connected to the second edge 314 of the side wall 310. The shield 300 may have a second end wall 330 having a first edge, a second edge and a third edge. The first edge of the second end wall 330 is for contacting the housing 228. The second edge of the second end wall 330 is for connecting to the third edge 316 of the side wall 310. Alternatively, the first end wall 322 and the second end wall 330 can be connected to the housing 228 and be insulative, rather than connected to or being a part of the shield 300. The middle portions 236 of the contact elements 235 are within the confines of the outer side wall 310, the first end wall 322 and the second end wall 330.

The elongated outer wall 310 and/or the side walls 322, 330 may have cleaning or draining passages (not depicted). Further, there may be stand offs along the edges of the walls 310, 322, 330 to allow cleaning fluids to pass through the connector 200.

Referring to FIGS. 1, 4 and 7, the angled or right angle electrical receptacle 200 may further include an insulative spacer 350 having a plurality of holes or slots 352 arranged in rows and columns. The spacer 350 may have stand offs 351. The contact elements 235 can extend through the holes 352 such that the eighth contacts 315 and the fourth contacts 255 are on one side of the spacer 350 and the middle portions 236 are on another side of the spacer 350. Further, the sixth contacts 275 and the seventh contacts 305 are preferably on the same side of the spacer 350 as the middle portions 236. The spacer 350 can have sleeves (not depicted) extending around the holes 352 for insertion into the pockets 308 to reduce lateral movement of the spacer 350 and the fourth contacts 255 with respect to the shield 300.

The third contacts 245 of the high density receptacle 200 can connect to any connector having a plurality of terminals or contact elements with a plurality of first contacts arranged in rows and columns with at least one second contact for engaging at least one of the fifth contacts 265. The header that is mateable with the receptacle 200 can be a vertical header or an angled or right angle header. Preferably, the terminals of the header that is mateable with the receptacle 200 are pins having a 0.24 inches by 0.24 inches square cross section.

The circuit assembly 224 can be any assembly that includes a plurality of conductors, leads, plated through holes or conductive paths, pads or areas 226. The circuit assembly 224 can be a printed wiring board or a printed circuit board, such as a backpanel, a mother board or a daughter board. The circuit assembly 224 can be a cable assembly. The circuit assembly 224 can be rigid or flexible. In one typical situation, the receptacle 200 is for electrically and mechanically interconnecting to a daughter board 224 and a mating header which is connected to a mother board that is perpendicular to the daughter board 224.

It will be recognized by those skilled in the art that the ground structure of the present invention can be modified to be used on any angled receptacle or header where the two contacts of the contact elements of the receptacle or header are at an angle other than 180 degrees from one another.

The parts referred to throughout this specification can be made from known materials used to make similar conventional parts. For instance, the insulative housings can be made of various plastics, such as polyetherimide resin or polyphenylene sulfide resin. The conductive walls, conductive bases, baffles and shields can be made of any nonmagnetic metal or metal alloy including zinc, aluminum, copper, brass or alloys thereof. The contact elements of the present invention can be made from any suitable metal used for electrical terminals, such as brass, phosphor bronze, beryllium copper and the like. The contact elements may be plated or coated with a conductive layer, such as tin, nickel, palladium, gold, silver or a suitable alloy.

Those skilled in the art, having the benefit of the teachings of the present invention as hereinabove set forth, can effect numerous modifications thereto. These modifications are to be construed as being encompassed within the scope of the present invention as set forth in the appended claims.

What is claimed is:

1. An electrical connector for electrically and mechanically interconnecting a circuit assembly having a plurality of contact regions and a mating connector having first side walls, a plurality of first contacts arranged in rows and columns within the first side walls and at least one second side contact, the connector comprising:

an insulative housing having second side walls and a plurality of passages arranged in rows and columns within the second side walls;

a first plurality of electrical contact elements wherein:

one of the contact elements is partially in each one of the passages, each contact element has a third contact and a fourth contact, the third contacts are arranged in rows and columns for contacting the first contacts, each one of the contact elements includes a middle portion configured such that their fourth contacts extend at an angle with respect to the third contacts, at least one conductor having at least one fifth contact and at least one sixth contact, the at least one fifth contact on one of the second side walls for contacting the at least one second contact on one of the first side walls; and a conductive shield including:

a baffle positioned between and spaced from columns of the middle portions of the contact elements, a seventh contact for contacting each of the sixth contacts, and a plurality of eighth contacts positioned such that the fourth contacts and the eighth contacts are arranged in rows and columns for connection to the circuit assembly contact regions.

2. The electrical connector of claim 1, wherein the at least one fifth contact is on an exterior surface of one of the second side walls.

3. The electrical connector of claim 1, wherein there are two of the conductors and the conductors are on different ones of the second side walls that are generally parallel to the row of the contact elements.

4. The electrical connector of claim 1, wherein the conductor has a plurality of the fifth contacts and a plurality of the sixth contacts.

5. The electrical connector of claim 1, further comprising:

an insulative spacer having a plurality of holes arranged in rows and columns; and the contact elements extending through the holes such that the fourth and eighth contacts are on one side of the spacer and the middle portions are on another side of the spacer.

6. The electrical connector of claim 1, wherein the middle portions have a right angle bend.

7. The electrical connector of claim 1, wherein the seventh contacts include slots or holes in the shield.

8. The electrical connector of claim 1, wherein the at least one conductor has a bent end portion for extending into a groove in a mating surface of the connector, such that when the bent end portion is extending into the groove and the at least one sixth contact is connected to the at least one seventh contact, then the conductor is secured on one of the second side walls.

9. The electrical connector of claim 1, wherein the housing has a plurality of projections, the at least one conductor has a plurality of slots or holes for receiving the projections and the shield has a plurality of slots or holes for receiving the projections.

* * * * *